US007010876B1

(12) United States Patent
Siegel et al.

(10) Patent No.: US 7,010,876 B1
(45) Date of Patent: Mar. 14, 2006

(54) APPARATUS AND METHOD FOR THE DISTRIBUTION OF CONSUMER PRODUCT INFORMATION

(75) Inventors: Alan A. Siegel, Orlando, FL (US); Rod Lowenstein, Jericho, NY (US)

(73) Assignee: Shape CD Ltd., Wilmington, DE (US)

( * ) Notice: Subject to any disclaimer, the term of this patent is extended or adjusted under 35 U.S.C. 154(b) by 149 days.

(21) Appl. No.: 09/659,525

(22) Filed: Sep. 12, 2000

(51) Int. Cl.
*G09F 3/00* (2006.01)

(52) U.S. Cl. ..... 40/299.01; 40/661.04; 206/308.1

(58) Field of Classification Search ..... 40/340, 40/329, 330, 661.04, 299.1; 369/273; 206/309, 206/308.1, 806, 308.2
See application file for complete search history.

(56) References Cited

U.S. PATENT DOCUMENTS

| | | | | | |
|---|---|---|---|---|---|
| 4,232,461 | A * | 11/1980 | Crawford | 40/340 |
| 5,090,561 | A * | 2/1992 | Spector | 206/313 |
| 5,217,056 | A * | 6/1993 | Ritter | 150/147 |
| 5,479,796 | A * | 1/1996 | Shimano | 63/2 |
| 5,690,220 | A * | 11/1997 | Swan | 206/308.1 |
| 5,740,155 | A | 4/1998 | Spector | |
| D394,648 | S | 5/1998 | Rohde | |
| 5,852,598 | A | 12/1998 | Wiest | |
| 5,882,555 | A | 3/1999 | Rohde et al. | |
| D419,151 | S | 1/2000 | Koedel | |
| D419,152 | S | 1/2000 | Lowenstein | |
| D421,427 | S | 3/2000 | Siegel | |
| 6,288,996 | B1 * | 9/2001 | Siegel | 369/273 |
| D454,910 | S * | 3/2002 | Smith et al. | D19/9 |
| 6,360,889 | B1 * | 3/2002 | Combs | 206/308.1 |
| 6,484,940 | B1 * | 11/2002 | Dilday et al. | 235/454 |
| 6,571,945 | B1 * | 6/2003 | Combs | 206/308.1 |
| 6,597,653 | B1 * | 7/2003 | Burnett | 369/273 |
| 2001/0038033 | A1 * | 11/2001 | Habib | 235/375 |
| 2001/0042009 | A1 * | 11/2001 | Montague | 705/14 |
| 2002/0162758 | A1 * | 11/2002 | Clemens | 206/308.1 |

* cited by examiner

*Primary Examiner*—Cassandra Davis
(74) *Attorney, Agent, or Firm*—Myron Greenspan, Esq.; Lackenbach Siegel LLP

(57) ABSTRACT

The hang tag and method for labeling products. The hang tag is composed of a digital memory encoded with product information and a connecting member which removably couples the digital memory to the product. In this way, the hang tag provides consumers with a wealth of information relating to accessories, operating instructions, general company data, customer service information, web site links, telephone contacts, and other information consumers may find useful.

21 Claims, 6 Drawing Sheets

514
516
512
515
517

APPARATUS AND METHOD FOR THE DISTRIBUTION OF CONSUMER PRODUCT INFORMATION

BACKGROUND OF THE INVENTION

1. Field of the Invention

The invention relates to a hang tag for clothing and other products for providing consumers with product information. More particularly, the invention relates to a hang tag providing digital information in addition to any printed information thereon, in the form an optically readable disk and a method for retailing products with such hang tags.

2. Description of the Prior Art

The proliferation of computers and information storage media has opened the door to the rapid distribution of vast amounts of information in an inexpensive, readily accessible manner. For example, it is common for Internet service providers, such as AOL, to mass mail software providing individuals with ready access to their services. The software is generally mass mailed in the form of optical disks, and more particularly, CD-ROMs, which may be conveniently read by the vast majority of computers being used throughout the United States, and the rest of the world.

The simplicity of transferring information in this manner has lead individuals and corporations to develop new and interesting methods for manufacturing and distributing information in the form of optical disks. For example, it has been found that CD-ROMs may be manufactured in a variety of shapes while still allowing the CD-ROMs to be read by conventional computer hardware.

In view of the speed at which technology is currently developing, and at which the storage of information in forms other than paper is being readily accepted by the masses, the possibilities for the ready exchange of information is only limited by the imagination of those at the cutting edge of technology and marketing. In fact, the versatility of compact digital storage mediums has to date only been applied in a limited number of applications.

One area in which the transfer of information is limited by the use of traditional information transfer techniques is consumer products. Specifically, when you purchase a new stereo, the box is filled with a variety of papers explaining how to assemble the stereo, how to use the stereo, who to call when the stereo malfunctions, etc. In many situations, the paper information may not answer highly specific questions easily and understandably concerning a new purchase. Similarly, when you receive a prescription, the bag is often filled with written information concerning the prescription you have just purchased. Unfortunately, however, this prescription information is often impossible to make sense of or only offers limited information concerning the drug you are intending to take. The number of situations in which consumer products are accompanied by limited or undecipherable information is frequent and causes purchasers to contact customer service because the information they require was not included or understandable with the highly limited reference materials accompanying their purchase.

The limited information currently provided to consumers similarly has an adverse effect on companies sincerely attempting to offer consumers a variety of information designed to improve their overall product experience. For example, it would be desirable for many companies to offer assembly and operational information in digital form to save the expense of providing this information in paper form. In addition, the use of digital information would provide these companies with the opportunity to easily provide consumers with easily understandable, additional information otherwise only available through a customer service representative. The additional information may further include promotional information encouraging consumers to purchase additional related products being sold by the company.

As such, a need continues to exist for a method, apparatus or system for facilitating the ready transfer of information between companies and the consumers purchasing their products. The present invention overcomes the limitations of prior information transfer techniques by providing system for the ready transfer of information.

SUMMARY OF THE INVENTION

It is, therefore, an object of the present invention to provide a hang tag for removable attachment to a product. The hang tag includes a digital memory encoded with information relating to a product to which it is to be attached. The hang tag further includes a connecting member for removably attaching the digital memory to a product.

It is also an object of the present invention to provide a hang tag wherein the connecting member includes an eyelet formed within or extending from the digital memory.

It is another object of the present invention to provide a hang tag wherein the connecting member includes a cord adapted for positioning between the product and the eyelet.

It is a further object of the present invention to provide a hang tag wherein the eyelet is frangibly or otherwise removably secured to the digital memory.

It is yet a further object of the present invention to provide a hang tag wherein the connecting member includes pouch in which the digital memory is selectively placed.

It is a still another object of the present invention to provide hang tag wherein the digital memory is an optical disk.

It is also another object of the present invention to provide a hang tag wherein the wherein the optical disk is a CD-ROM.

It is a further object of the present invention to provide a hang tag wherein the digital memory is non-circular.

It yet another object of the present invention to provide a method for labeling products so as to provide consumers with a wealth of information relating to the product. The method is achieved by producing a hang tag including a digital memory encoded with information relating to a product to which it is to be attached and means for removable attachment to the product and attaching the hang tag to the product.

It is a further object of the present invention to provide a product including a hang tag as discussed above.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 2 is an upper face view of the hang tag disclosed in FIG. 1.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
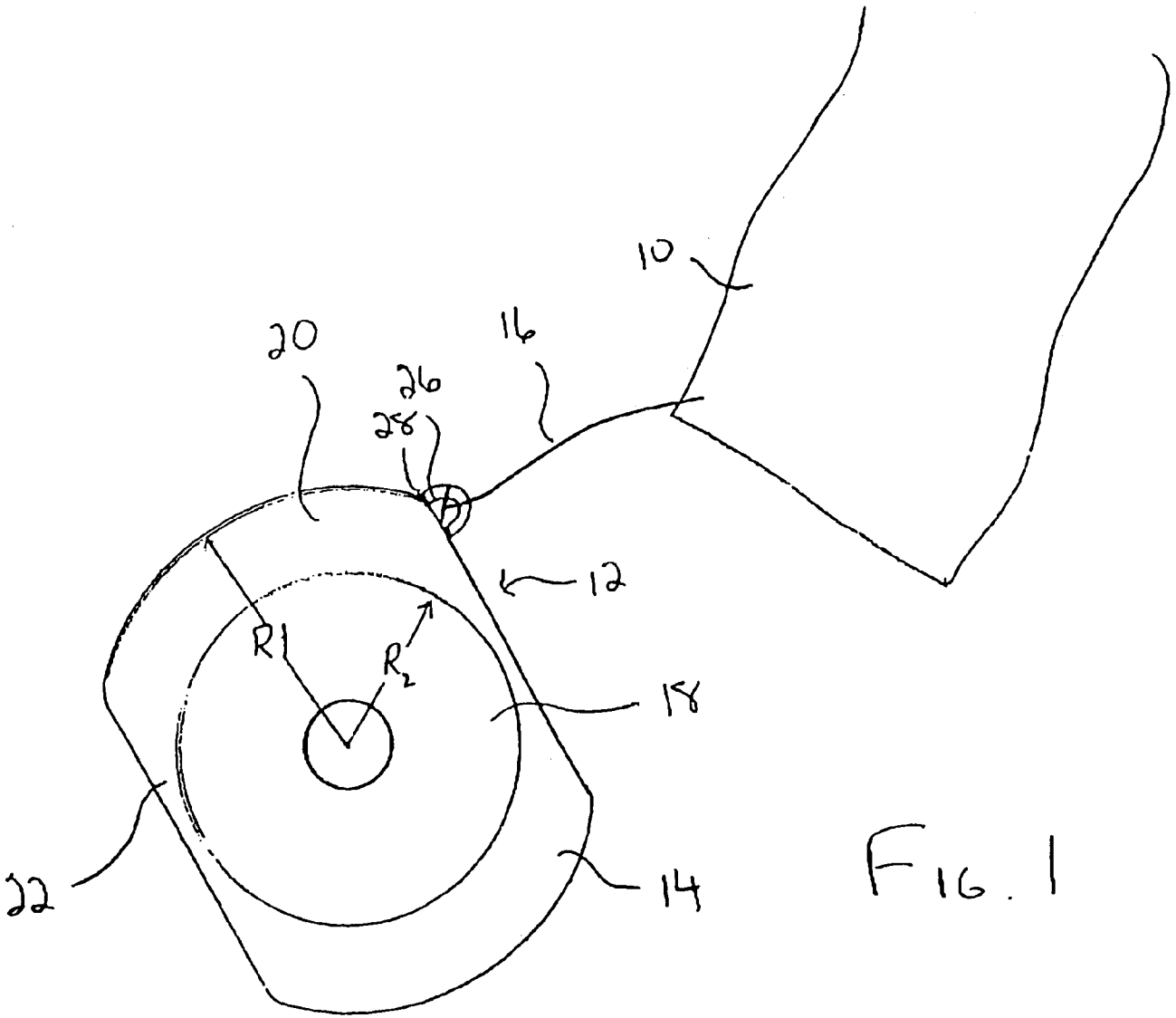
FIG. 1 is a bottom face view of the hang tag in accordance with present invention.
Figure 8:
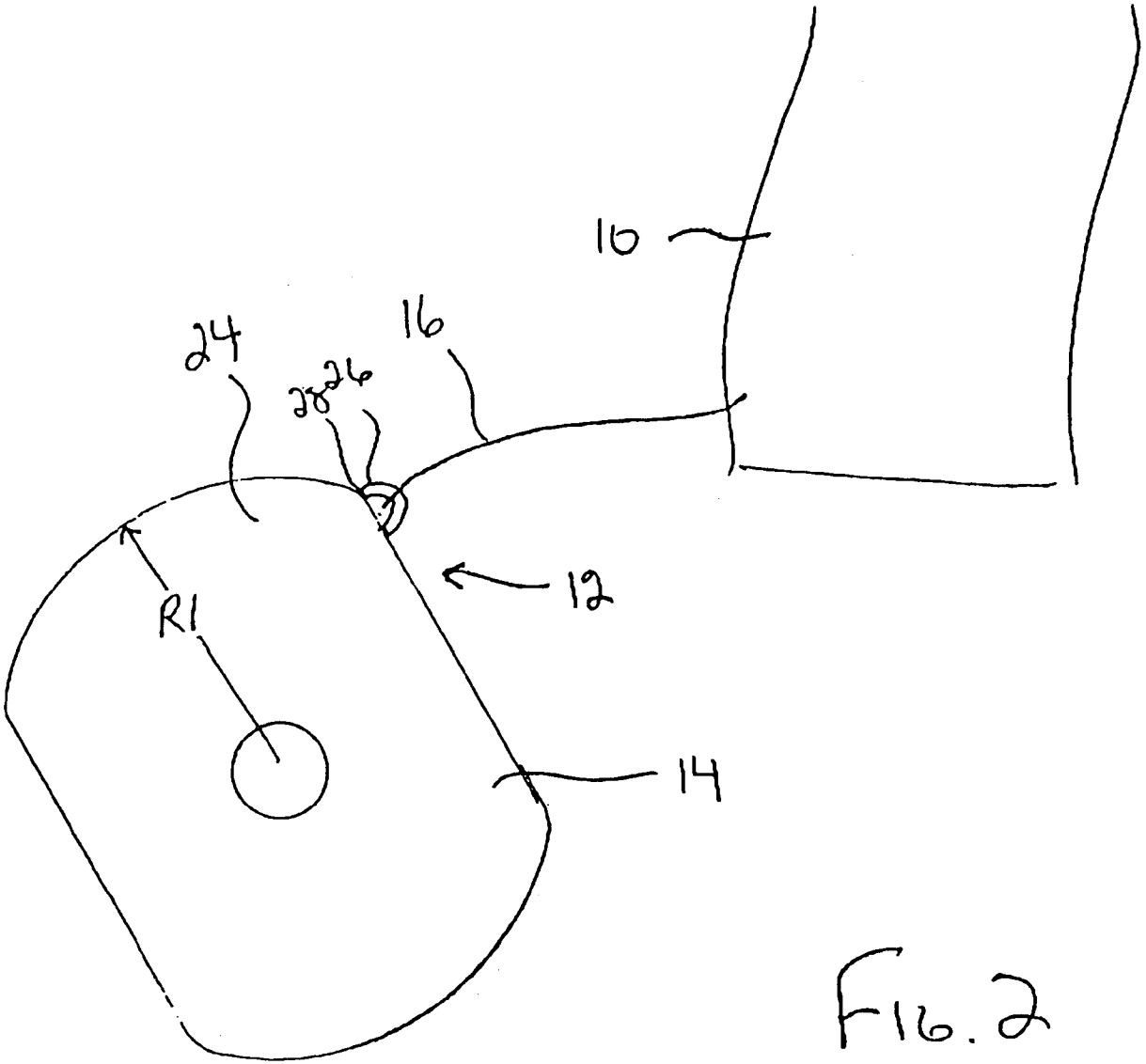
Figure 4:
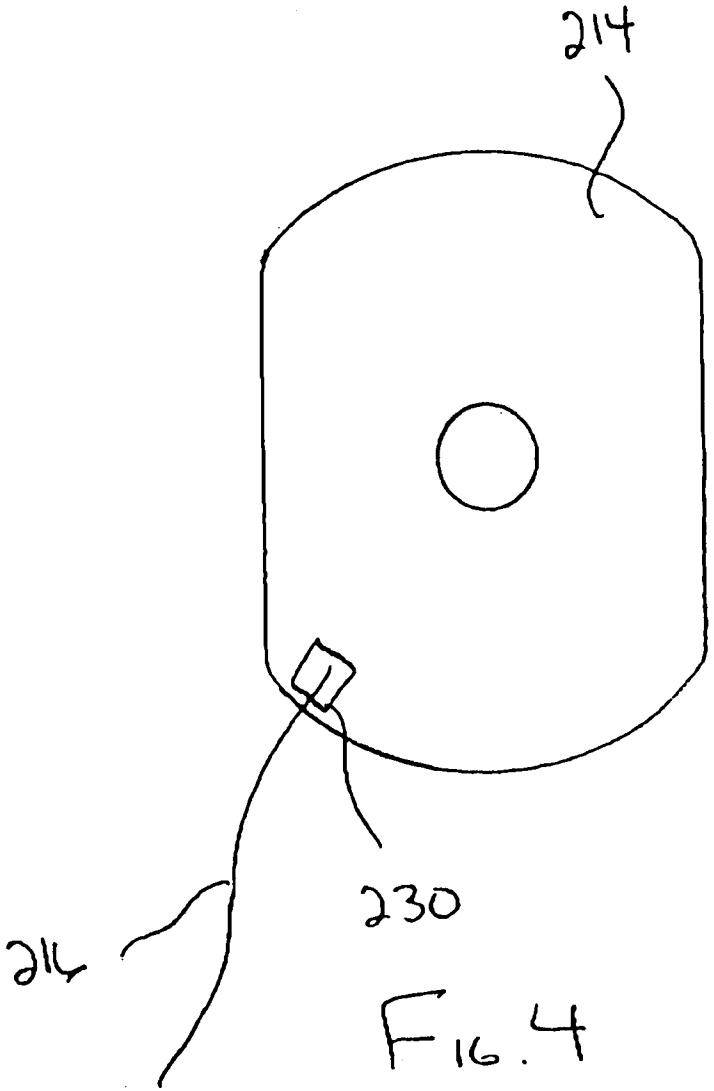
FIGS. 3 to 7 disclose various embodiments of hang tags in accordance with the present invention.

With reference to FIGS. 1 and 2, a product 10, for example, an article of clothing, is disclosed in accordance with the present invention. The article of clothing 10 is provided with a hang tag 12 composed of an optical disk, or other digital memory, 14 encoded with information relating to the product 10 to which it is attached. The hang tag 12 further includes a connecting member 16 selectively securing the optical disk 14 to the article of clothing, or other product, 10.

As those skilled in the art will readily appreciate, the optical disk 14 includes digitally encoded information relating to the article of clothing 10 to which it is attached. The optical disk may take the form of conventional CD-ROMs currently available, or other optical recording mediums, for example, DVDs, without departing from the spirit of the present invention. Although optical disks are currently very popular for use in distributing large quantities of information, those skilled in the art will appreciate the various information storage mediums that might also be used in accordance with the present invention without departing from the spirit of the present invention.

In addition, and as disclosed in the "Background of the Invention", the optical disks may be formed in a variety of shapes while still permitting reading in conventional CD-ROM players. The use of various shapes adds to the aesthetic appeal of the hang tags used in accordance with the present invention, while also offering a distinctive method for labeling articles of clothing, and other products. Techniques currently exist for providing an optical disk having a non-circular outer profile. For example, U.S. Pat. No. 5,882,555, entitled "Apparatus and Method for Manufacturing Compact Discs Having a Non-Round Outer Profile", discloses such a technique and is incorporated herein by reference.

Generally, the shaped optical disk 14 is formed with a radius R1 measured from the center of the disk (i.e. the center of the center hole) to the furthest point on the outer profile such that the disk 14 fits within the usually round receiving tray of a conventional CD-ROM player. In other words, the radius R1 must be less than or equal to the inside diameter of the receiving tray of the CD-ROM player. However, since the non-circular optical disk 14 will have the usual center hole found on standard round CD-ROMs, these non-circular optical disks 14 properly spin within the receiving tray of a CD-ROM player.

While the outer profile of the optical disk 14 is disclosed as being a non-round shape, the readable digital information provided on the disk is provided in the usual annular arrangement. However, in order to insure that all of the intended information is readable, the outer limit R2 of the annularly arranged information region 18 must not extend beyond the innermost point of the outer profile.

Considering the fact that CD-ROMs are shaped and, thereby, limited with regard to the annular surface which may be encoded with relevant information, the CD-ROMs applied in accordance with the present invention preferably adopt the technology used in the manufacture of mini-disk CD-ROMs (i.e., optical read only memory disks which have a smaller diameter than conventional CD-ROMs.). Specifically, recent innovations provide a CD-ROM disk having a disk bottom face 20 with a central mini-disk circular functional surface region 18. The mini-disk circular functional surface region 18 is a digital laser readable region having laser readable data imprinted thereon. A non-functional outer region 22 exists between the central mini-disk circular functional surface region 18 and the outer perimeter, or profile, of the disk 14. Various types of visually readable printed labels and artwork can be applied to both non-functional annular region 22 of the bottom face 20 of the disk 14 and to the upper face 24 of the optical disk 14.

These smaller, mini-disks, may be used in accordance with the present invention by assuming that the mini-disk circular functional surface region 18 makes up the information encoded center of the optically readable disk 14 and the non-functional annular region 22 surrounding the mini-disk circular functional surface region 18 is not encoded with digital information. These non-circular perimeter disks can be placed into the circular receiving tray of a CD-ROM player so that the mini-disk CD-ROM is rotated and the data on the mini-disk circular functional surface region 18 is read by a laser in the same manner as disks having a circular perimeter. Centering is accomplished by having at least three points of the circumference on the mini-disk CD-ROM in alignment with the inside diameter of the receiving tray.

From an aesthetic point of view, the CD-ROMs are manufactured with an upper face 24 labeled with a graphic design associated with the product 10 to which it is attached. The second side, or bottom face, 20 is a traditional recording surface upon which the digitally encoded information is applied. The upper and bottom faces 22, 20 of the optical disk 14 may be further covered with a protective film to ensure that proper reading of the information stored thereon is achieved when the consumer finally brings the optical disk home and inserts it within his or her computer. With this in mind, optical disks in accordance with the present invention are highly versatile and may be manufactured with an infinite variety of designs specifically designed to suit the needs of the product seller.

The connecting member 16 is secured between the optical disk 14 and the article of clothing 10 using conventional application techniques. As such, the optical disk 14 is provided with an aperture 26 positioned so as not to interfere with the reading of information therefrom. In this way, the connecting member 16 may be readily coupled between the article of clothing 10 and the optical disk 14. It is contemplated that the connecting member 16 may take a variety of forms including, but not limited to, plastic inserts, thread, cord, etc.

In accordance with the embodiment disclosed in FIGS. 1 and 2, and to avoid interference with the information digitally encoded on the optical disk 14, the aperture 26 is formed as a removable or frangible eyelet secured along the periphery of the optical disk 14. The edges of the eyelet are, therefore, scored 28 such that the eyelet aperture 26 may be removed, by breaking away, from the optical disk 14 once the consumer is prepared to read the optical disk 14 on a computer.

Figure 3:
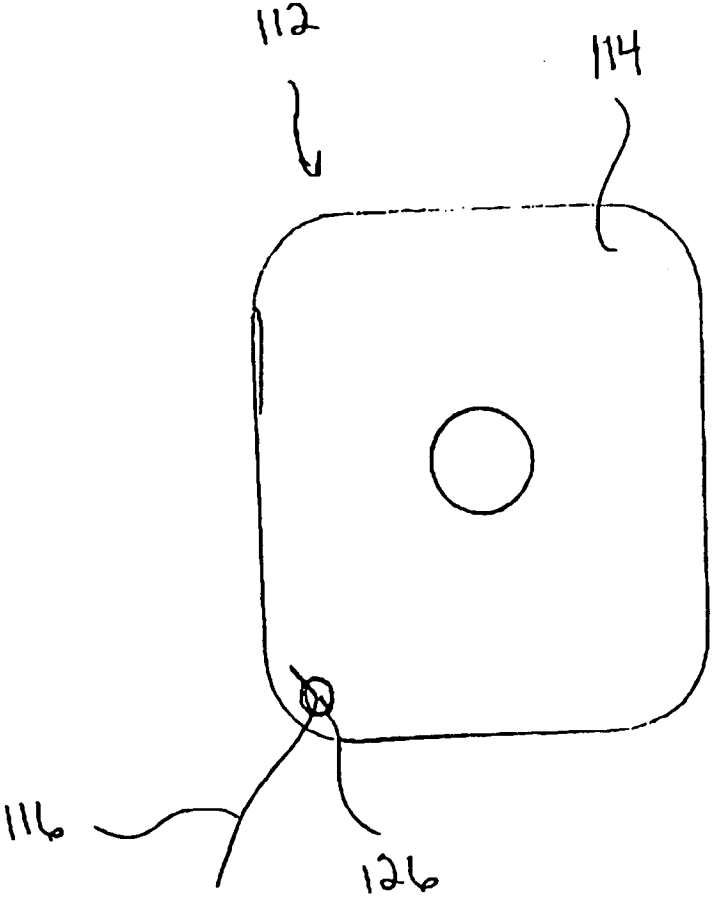

With reference to FIGS. 3 to 7, other embodiments of hang tags in accordance with the present invention are disclosed. Referring to FIG. 3, a hang tag 112 is disclosed wherein attachment of the connecting member 116 between the optical disk 114 and the article of clothing is facilitated by the inclusion of an aperture 126 in the optical disk 114 within which the connecting member 116 may be removably secured to the optical disk 114.

As will be shown in other embodiments disclosed below, the aperture for the connecting member may be formed at various points on the optical disk without departing from the spirit of the present invention. In fact, and in accordance with the present invention, the aperture may be formed at any point along the optical disk so long as the aperture does not adversely affect the consumer's ability to read the information encoded on the optical disk.

In addition, the connecting member may be secured to the optical disk using other attachment mechanisms, including, but not limited to, various bonding techniques advantageously employed in conjunction with the optical disks. For example, and with reference to FIG. 4, adhesive tape 230 may be used to couple a cord 216 to the optical disk 214.

Figure 5:
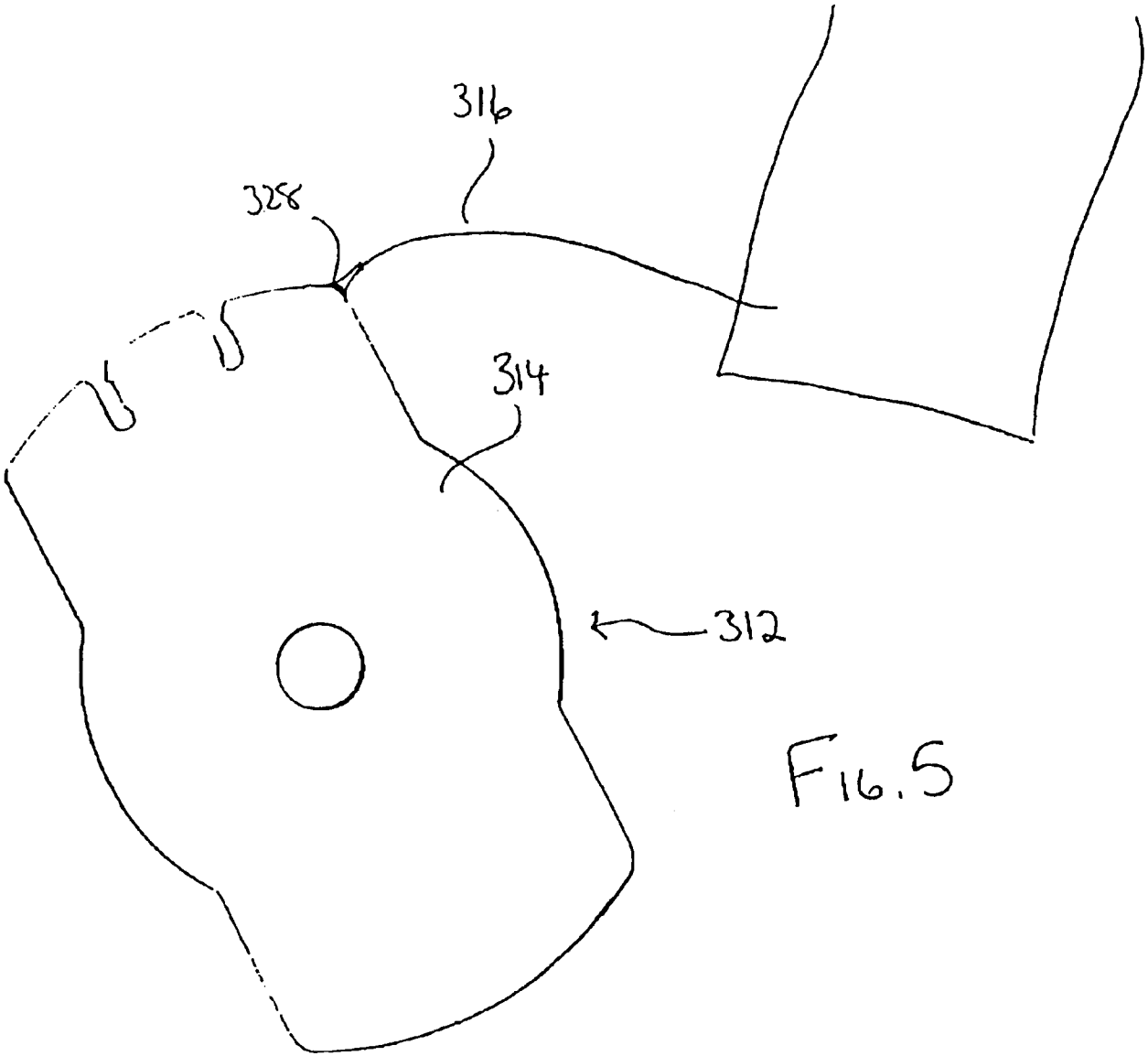
Figure 6:
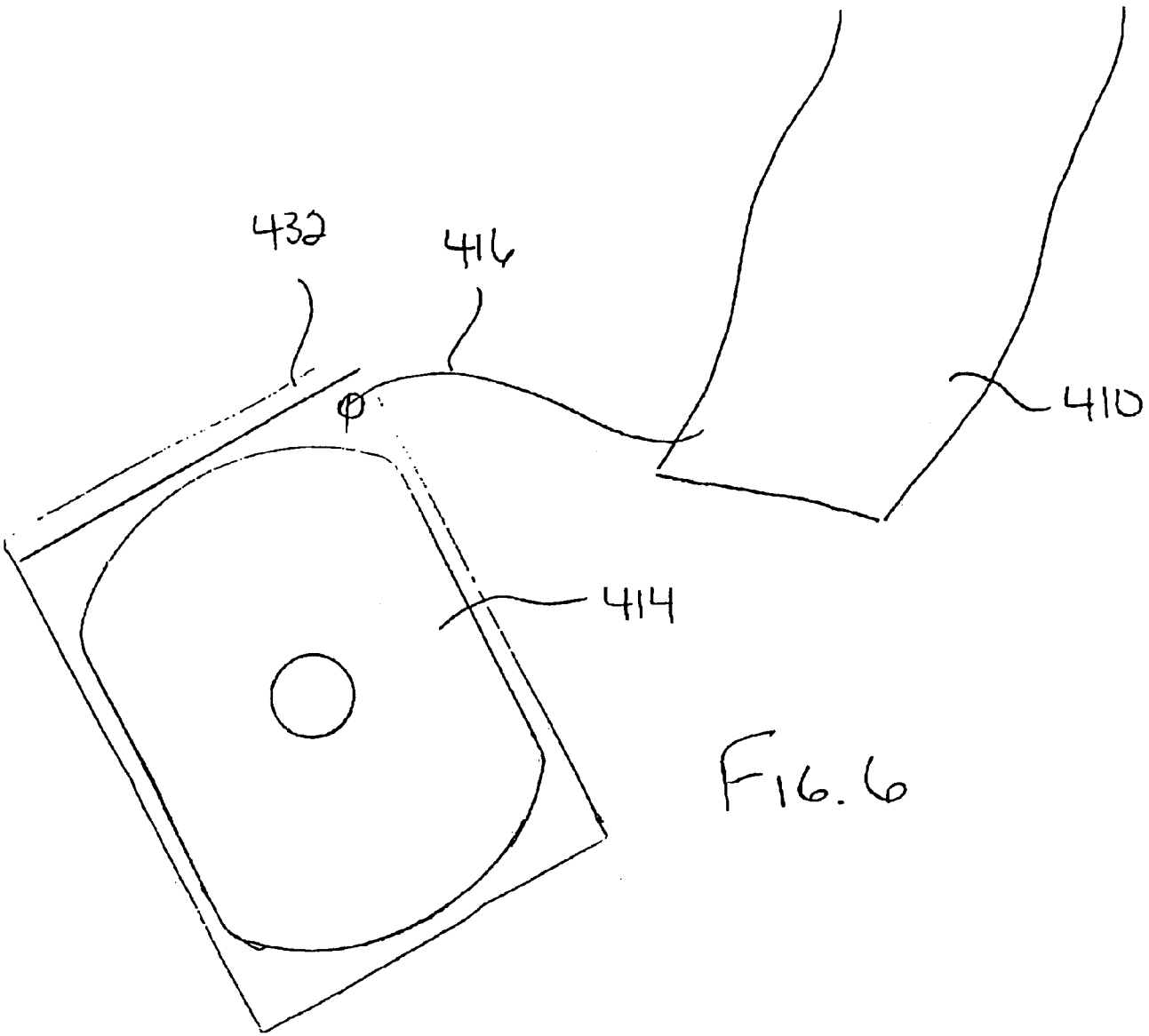

Alternately, and with reference to FIG. 5, the optical disk 314 and connecting member 316 may be integrally formed. In accordance with such an embodiment, it is contemplated that the connecting member 316 is linked to the optical disk via a score line 328 at which the connecting member 316 may be broken from the optical disk 314 when the consumer chooses to remove the hang tag 312. Similarly, the disk 414 may be placed in a pouch 432 including a cord 416 for attachment to the product 410 (see FIG. 6).

Figure 7:
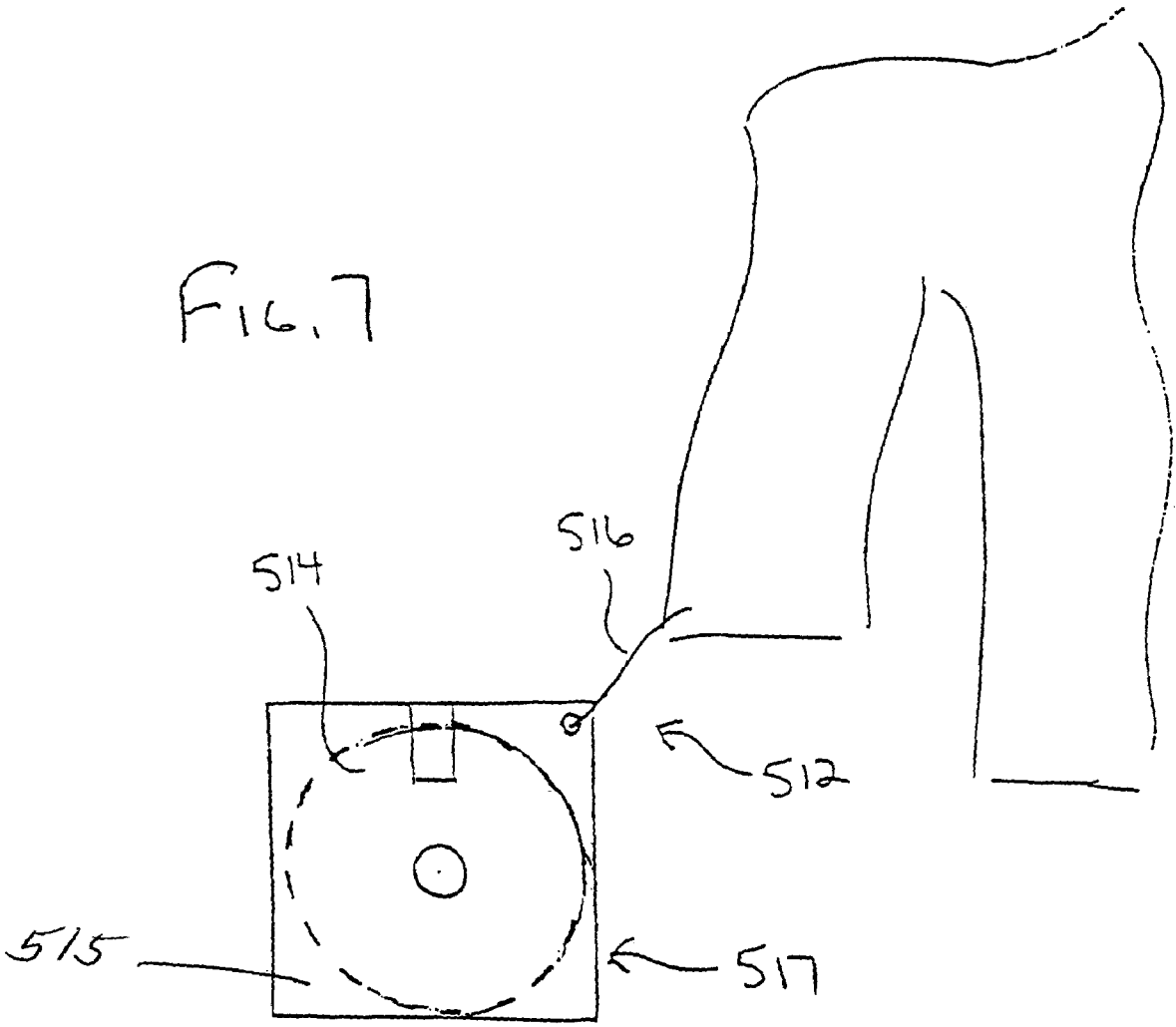

With reference to FIG. 7, a further embodiment of the present invention is disclosed. In accordance with this embodiment, the hang tag 512 is composed of a mini disk CD-ROM 514 stored within an enclosure 515 and a connecting member 516. In accordance with traditional technology, the disclosed mini-disk 514 is approximately 2½" in diameter and is stored with a plastic protective enclosure 515 to form a cartridge 517. The enclosure 515 protects the disk 514 surface from damage in a manner analogous to commonly used magnetic diskettes. The cartridge 517 enables the mini-disk 514 to be played by a mini-disk receiving compartment of a mini-disk player. As with conventional CD-ROM players, the mini-disk player uses a laser to digitally read the information encoded on the mini-disk CD-ROM. It is contemplated that such mini-disks would be particularly useful in conjunction with personal digital assistants providing an individual with the portability to study the contents of the hang tag at a variety of locations.

With regard to the use of the present hang tag in conjunction with an article of clothing, it is preferably encoded with information regarding care, manufacturing and sizing information. In addition, the hang tag may be encoded with coordinate clothing items, information about the manufacturer, the retailer, the type of clothing including coordinated items, etc., as well as the retail price. Also, provide links to affiliated company web sites, provide the ability to see the colors of other available similar or the same items, etc. Information on an entire product line, washing instructions, fabric content and care, how the garment was made, are all easily provided using audio and video displays. And the presentation may be able to be user accessed selectively, to interest all types of buyers and users. In addition, the optical disk may be encoded to facilitate dial-up through the user's modem for registration or interactive reasons, and indeed may be able to open a resident browser to interface and log onto the manufacturer, retailer, product, website, etc. With this in mind, the hang tag may be encoded with both audio and video data to provide a comprehensive collection of information. Survey information, warranty and guarantee registration, lottery entry, etc., are all possible as interactive capabilities may be incorporated on the hang tag.

With reference to FIGS. 1 to 7, various shapes and designs contemplated for use in conjunction with the present invention are disclosed. As those skilled in the art will readily appreciate, and as discussed above, the shape of the optical disk is not critical to the operation of the present invention and may be readily varied without departing from the spirit of the present invention.

Although the present hang tag is disclosed above for use with an article of clothing, the hang tag may be used in combination with a wide range of products. For example, the hang tag might be used in combination with medicine as a means of providing the patient with a full range of product information and drug interaction information. In addition, the hang tag might be used in combination with products requiring assembly, for example, children's toys. When used in combination with unassembled products, the hang tag may be provided with assembly information in addition to the information discussed above, as well as use and safety guides. It should, however, be understood that the uses for the present hang tag are highly varied, and those skilled in the art will appreciate the wide range of applications for the present invention.

While the preferred embodiments have been shown and described, it will be understood that there is no intent to limit the invention by such disclosure, but rather, is intended to coverall modifications and alternate constructions falling within the spirit and scope of the invention as defined in the appended claims.

What is claimed is:

1. A hang tag for attachment to a product, comprising:

an optical memory encoded with selected information to which the hang tag is attached;

a protective enclosure dimensioned to receive said optical memory;

attachment means for selectively attaching said protective enclosure to a product; and access means, including permanently alterable means, cooperating with said protective enclosure for initially obstructing said optical memory from being removed from said protective enclosure and for subsequently permanently eliminating any obstruction to allow for free movement of said optical memory from and into said protective enclosure after said access means is altered by a user to allow said optical memory to be initially withdrawn from said protective enclosure, said attachment means forming at least part of said permanently alterable means.

2. The hang tag according to claim 1, wherein the optical memory is an optical disk.

3. The hang tag according to claim 2, wherein the optical disk is a CD-ROM.

4. A hang tag according to claim 1, wherein the optical memory is non-circular.

5. The hangtag according to claim 1, wherein said attachment means comprises an elongate member attached to said pouch and attachable to the product.

6. The hang tag according to claim 5, wherein said elongate member comprises a cord adapted for positioning between the product and said pouch.

7. The hangtag according to claim 1, wherein said protective enclosure comprises two juxtaposed flat panels attached about their peripheral edges.

8. The hangtag according to claim 7, wherein said access means comprises a sealed edge of said juxtaposed panels that is severable by a user to expose an opening for removing said optical memory.

9. The hangtag according to claim 1, wherein said access means comprises said attachments means secured to said protective enclosure at a location to initially block removal of said optical memory.

10. The hangtag according to claim 1, wherein the information encoded on said optical memory includes information relating to the product to which the hangtag is to be attached.

11. A method for labeling products so as to provide consumers with selected information, comprising:

producing a hang tag including an optical memory encoded with information relating to a product to which it is to be attached;

inserting said optical memory within a protective enclosure dimensioned to receive and protectively enclose said optical memory;

said protective enclosure normally being closed to prevent movement of said optical memory out of said protective enclosure:

selectively attaching said protective enclosure to the product using an attachment means; and initially obstructing with access means said optical memory from being removed from said protective enclosure and subsequently permanently eliminating any obstruction to allow for free movement of said optical memory from and into said protective enclosure after said access means is altered by a user to allow said optical memory lo be initially withdrawn from said protective enclosure said attachment means forming at least part of said permanently alterable means.

12. The method according to claim 11, wherein said attachment means an elongated member in the form of a cord.

13. The method according to claim 11, wherein the optical memory is a CD-ROM.

14. The method according to claim 11, wherein the optical memory is non-circular.

15. The method according to claim 11, wherein the information encoded on said optical memory includes information relating to the product to which the hangtag is to be attached.

16. A product including a hang tag attached thereto for providing consumers with selected information, the hang tag comprising:

an optical memory encoded with information relating to a product to which the hang tag is attached;

means for attachment to a product, a protective enclosure dimensioned to receive said optical memory;

access means cooperating with said protective enclosure and for initially obstructing said optical memory from being removed from said protective enclosure and subsequently permanently eliminating any obstruction to allow for free movement of said optical memory from and into said protective enclosure after said access means is altered by a user to allow said optical memory is initially withdrawn from said protective enclosure said attachment means forming at least part of said Permanently alterable means.

17. The product according to claim 16, wherein the optical memory is a CD-ROM.

18. The product according to claim 16, wherein the optical memory is non-circular.

19. A product according to claim 16, wherein said attachment means comprises an elongate member attached to said pouch and attachable to the product.

20. The product according to claim 19, wherein said elongate member comprises a cord adapted for positioning between the product and said pouch.

21. The method according to claim 16, wherein the information encoded on said optical memory includes information relating to the product to which the hangtag is to be attached.

* * * * *